US011754373B2

(12) United States Patent
Connolly

(10) Patent No.: US 11,754,373 B2
(45) Date of Patent: Sep. 12, 2023

(54) COMPACT LOCKING RAIL MOUNT AND MOUNTING ASSEMBLY

(71) Applicant: RAYTHEON CANADA LIMITED, Ottawa (CA)

(72) Inventor: John Maxwell Connolly, Midland (CA)

(73) Assignee: RAYTHEON CANADA LIMITED, Ottawa (CA)

( * ) Notice: Subject to any disclaimer, the term of this patent is extended or adjusted under 35 U.S.C. 154(b) by 0 days.

(21) Appl. No.: 17/734,493

(22) Filed: May 2, 2022

(65) Prior Publication Data

US 2022/0357131 A1 Nov. 10, 2022

Related U.S. Application Data

(60) Provisional application No. 63/185,468, filed on May 7, 2021.

(51) Int. Cl.
*F41G 11/00* (2006.01)

(52) U.S. Cl.
CPC ..... *F41G 11/003* (2013.01); *F41G 11/004* (2013.01)

(58) Field of Classification Search
CPC ..... F41G 11/003; F41G 11/004
USPC ..... 42/111, 124
See application file for complete search history.

(56) References Cited

U.S. PATENT DOCUMENTS 6,435,738 B1 8/2002 Vogt
6,931,778 B1 8/2005 Nelson et al.
8,336,246 B1 * 12/2012 Barber ..... F41G 11/003 42/127
8,438,965 B2 5/2013 Collin et al.
8,468,735 B1 * 6/2013 Keng ..... F41G 1/08 42/148
8,935,875 B2 1/2015 Collin et al.
9,568,281 B1 2/2017 Chen
9,581,416 B1 2/2017 Yim et al.
10,036,614 B1 7/2018 Ruiz
10,557,487 B2 2/2020 Larue
10,801,814 B2 10/2020 Ma
10,866,066 B2 12/2020 Ma et al.
(Continued)

FOREIGN PATENT DOCUMENTS

WO 2017091882 A1 6/2017
WO 2022235936 A1 11/2022
WO 2022236252 A1 11/2022

*Primary Examiner* — John Cooper
(74) *Attorney, Agent, or Firm* — Burns & Levinson, LLP; Joseph M. Maraia

(57) ABSTRACT

A locking rail mount including a body mounted adjacent to a mounting rail and a clamp screw extending through a channel defined by the body and across the mounting rail. The clamp screw includes a screw head having a surface facing toward the mounting rail with locking elements having a surface relief geometry. At least one compression spring is positioned between the body and a rail clamp that pushes the rail clamp toward the surface of the screw head. The surface of the rail clamp includes locking elements having the surface relief geometry that are complementarily arranged with respect to the locking elements of the screw head. When the clamp screw is tightened, the locking elements of the rail clamp and screw head are aligned to lock the rail clamp and clamp screw together to prevent unintended rotation of the clamp screw.

20 Claims, 11 Drawing Sheets

(56) References Cited

U.S. PATENT DOCUMENTS

| | | | | |
|---|---|---|---|---|
| 10,895,436 | B2 * | 1/2021 | Ross | F41G 11/004 |
| 10,955,221 | B2 | 3/2021 | Duncan, III | |
| 2007/0234623 | A1 | 10/2007 | Carney | |
| 2008/0216380 | A1 * | 9/2008 | Teetzel | F41G 11/003 42/127 |
| 2011/0067287 | A1 * | 3/2011 | Collin | F41G 11/003 42/90 |
| 2012/0085014 | A1 * | 4/2012 | Riley | F41G 11/004 42/115 |
| 2013/0156495 | A1 | 6/2013 | Li et al. | |
| 2014/0137457 | A1 * | 5/2014 | Collin | F41G 11/003 42/90 |
| 2015/0362291 | A1 | 12/2015 | Samson et al. | |
| 2016/0202016 | A1 | 6/2016 | Mather et al. | |
| 2017/0102213 | A1 | 4/2017 | Bartoszewicz | |
| 2018/0259298 | A1 | 9/2018 | Gao | |
| 2018/0340754 | A1 * | 11/2018 | Cosentino | F41G 11/003 |
| 2020/0271423 | A1 | 8/2020 | Liu et al. | |
| 2021/0293512 | A1 | 9/2021 | Duncan, III | |
| 2022/0214142 | A1 | 7/2022 | Ding et al. | |

* cited by examiner

SECTION A-A

COMPACT LOCKING RAIL MOUNT AND MOUNTING ASSEMBLY

REFERENCE TO RELATED APPLICATIONS

This application claims priority to and the benefit of U.S. Provisional Patent Application No. 63/185,468, filed on May 7, 2021, entitled "COMPACT LOCKING RAIL MOUNT," the entire content of which are incorporated herein by reference.

TECHNICAL FIELD

This application relates generally to rail mounting assemblies and, more particularly, to compact rail mounting assemblies.

BACKGROUND

Rail mounting assemblies are used to mount devices such as optical sights or other accessories onto rifles, similar weapons, or other devices that generate significant shock profiles which poses a challenge to device retention. Existing attempts to retain these devices often include using bolted connections that rely on thread locking adhesive, nylon locking inserts, or similar thread lockers to keep them from backing off Mounting small devices such as red dot sights, flashlights, laser beam sights or designators on standard rails such as Picatinny, NATO or other rails often results in disproportionally large mounting mechanics or mounts with retention issues. Large lever locking rail mount designs commonly used to mount large telescopic type sights are sometimes used on small rail mounted devices, defeating the attempt to provide a compact solution. In some designs, mechanical locks are added to prevent loosening of the device. These typically are sliding or rotary keys or tabs that act independently from the mounting mechanics. Large mounting mechanics can be a snag hazard and cause an obstruction to the scene in a sight. More compact rail mounts often have multiple small parts and fasteners that are potential points of failure and increase the cost of the solution. Existing rail mounts typically require the use of thread locking adhesives to mitigate the risk of the mounted device coming loose due to shock or vibration.

Accordingly, there is a need for more reliable, more resilient, and less cumbersome rail mounting systems.

SUMMARY

The application, in various implementations, addresses deficiencies associated with existing rail mounts or mounting systems. The application includes exemplary mounts and assemblies that provide reliable and resilient mounting of accessories that are resistant to substantial and repeated shocks produced by a firearm or other device.

This application describes exemplary mounts and assemblies that use the body of the device to thread a clamp screw into or an insert into the body if the body material is not suitable for a threaded interface (e.g., plastic). Female features on the inward side of a head of the clamp screw are equally distributed around its diameter and used to prevent inadvertent rotation. These female locking features match with male locking features on a clamp component in terms of their general size, but more specifically with their respect to their pattern distribution. The angular separation of these features, the pitch of the clamp screw, and the stroke of spring pressure are taken into consideration to ensure optimal performance. In certain implementations, at least one set of these features, either male or female, have a cam angle or similar geometry associated to its interface to allow the clamp screw to be rotated by a user. Cam angles or similar geometry on both sets can improve the design's ease of use and the male/female designation is interchangeable. In some configurations, resilient devices such as disc springs and/or compression springs are installed between the base of the device and the rail clamp. As the clamp screw is rotated to clamp the device to the rail, the rail clamp is drawn in and the spring pressure increased.

In various implementations, the locking features mate and cam apart as the clamp screw is rotated. This camming action causes the rail clamp to move axially while increasing the spring load as the head of the clamp screw rides over the male locking feature. When the locking features align again, the spring pressure is slightly reduced and the engaged features act to lock the rail clamp and clamp screw together to, thereby, prevent unintended rotation. The user can continue to tighten the clamp screw, either by hand or using a tool feature on the screw head, until satisfied with the clamping pressure applied or until the screw no longer indexes. In one configuration, the mechanics will be at the maximum spring force when the clamp screw can no longer be rotated and the locking features are mated.

In some implementations, when the clamp screw has been tightened to secure the device to the rail, a rotation of the clamp screw with enough torque to overcome the increased spring pressure induced by the rail clamp's axial movement is required to loosen the rail mounted device. This has the technical effect of reducing the clamping force only and would need to be repeated multiple times to loosen the device and several times to free the device from the rail.

In various configurations, integral features on the inward side of the clamp screw and outward face of the rail clamp enable part reduction which impacts both the reliability and cost of the clamping solution. Incorporating compression springs into the design improves the ease in which the device is installed and removed from a rail. The use of disc springs allows for a compact design while providing the necessary clamping force to secure the device to the rail and load the locking interface. Threading directly into the base of the device to interface with the clamp screw simplifies the design with a minimum of parts required. Machined features in the base also function to heel the rail clamp as the device is clamped to the rail.

In one aspect, a locking rail mount includes a body arranged to be mounted adjacent to a mounting rail where the mounting rail extends in a first direction and includes a plurality of ties extending at least partially across the rail in a second direction substantially perpendicular to the first direction. The rail mount also includes a clamp screw extending through a channel defined by the body and across the mounting rail in the second direction. The clamp screw includes a screw head having a first surface facing away from the mounting rail and a second surface facing toward the mounting rail. The second surface includes a first plurality of locking elements where each has a first surface relief geometry.

The rail mount further includes a rail clamp arranged to: i) engage with a first end of a first tie of the plurality of ties to hold the body adjacent to the mounting rail; and ii) disengage from the first end of the first tie of the plurality of ties and release the body from adjacent to the mounting rail. At least one compression spring is positioned between the body and the rail clamp. The at least one compression spring applies a compression force that pushes a first surface of the rail clamp toward the second surface of the screw head. The first surface of the rail clamp includes a second plurality of locking elements complementarily arranged with respect to the first plurality of locking elements and having a second surface relief geometry that is complementary and/or opposing to the first plurality of locking elements. When the clamp screw is tightened, the first plurality of locking elements and second plurality of locking elements are aligned to lock the rail clamp and clamp screw together to prevent unintended rotation of the clamp screw.

In some implementations, the body is a portion of an accessory. The accessory may include an optical sight, camera, phone, light, laser, audio sensor, audio emitter, or detachably connectable tool. The surface relief geometry may include a cam angle. The mounting rail may be located on a firearm, helmet, pack, wearable item, or vehicle. At least one compression spring may cause axial movement along the clamp screw as the clamp screw is rotated to either tighten or loosen the rail clamp. The rail mount may include at least one disc spring. The at least one compression spring and the at least one disc spring may cause the axial movement along the clamp screw as the clamp screw is rotated to either tighten or loosen the rail clamp.

In some implementations, the axial movement along the clamp screw as the clamp screw rotates provides a positive tactile interface to a user. The positive tactile interface may reduce the likelihood of the clamp screw being over-tightened to a point of damaging the mechanics of the locking rail mount. In some configurations, when the clamp screw is tightened to secure the body to the rail, a rotation of the clamp screw with enough torque to overcome the increased compression spring pressure induced by the rail clamp's axial movement is required to loosen the rail mounted body.

In another aspect, the above-described locking rail mount is part of a rail mounting assembly where the rail mounting assembly includes a mounting interface arranged to connect an accessory to the rail mounting assembly while the rail mounting assembly uses the locking rail mount to connect to the mounting rail. In a further aspect, a firearm includes the above-described mounting rail, which is arranged to receive a rail mounting assembly having the above-described locking rail mount.

Any two or more of the features described in this specification, including in this summary section, may be combined to form implementations not specifically described in this specification. While aspects of the disclosure may relate to military applications, these aspects can also relate to non-military and commercial applications. For instance, implementations of the compact rail mount or rail mounting assembly may be used with hunting and/or sporting rifles or other non-military firearms. Implementations of the rail mount or rail mounting assembly described herein may be used to mount various types of accessories to various types of structures and/or items. For example, a rail may be implemented on a vehicle such as a car, truck, bicycle, motorcycle, plane, boat, and the like. A rail may be implemented on a helmet, pack, or other wearable items. The type of accessory may include, without limitation, a camera, phone, light, audio sensor, audio emitter, detachably connectable tool, and the like.

The details of one or more implementations are set forth in the accompanying drawings and the following description. Other features and advantages will be apparent from the description and drawings, and from the claims.

DESCRIPTION OF THE DRAWINGS

Like reference numerals in different figures indicate like elements.

DETAILED DESCRIPTION

The application, in various implementations, addresses deficiencies associated with existing rail mounting devices and systems. The application includes exemplary devices, systems, and assemblies for providing reliable, resilient, and user-friendly rail mounting techniques.

Innovative aspects of the disclosure include a compact locking rail mount design with a minimum of machined parts required to meet design to cost goals and improve reliability. This robust solution has integral mechanical locking features preventing the device from loosening on the rail when exposed to shock and vibration events without the need for thread locking adhesive. Disc and/or compression springs are used as a resilient feature in conjunction with the mechanical locking features to cause axial movement along the locking screw as the screw is rotated to either tighten or loosen the locking and/or rail clamp. Using axial movement is very desirable as it requires the disc and/or compression spring pressure to be increased to overcome the mechanical lock. The design provides a user with a positive tactile interface reducing the likelihood of the screw being over-tightened to the point of damaging the mechanics of the locking rail mount.

Figure 1A:
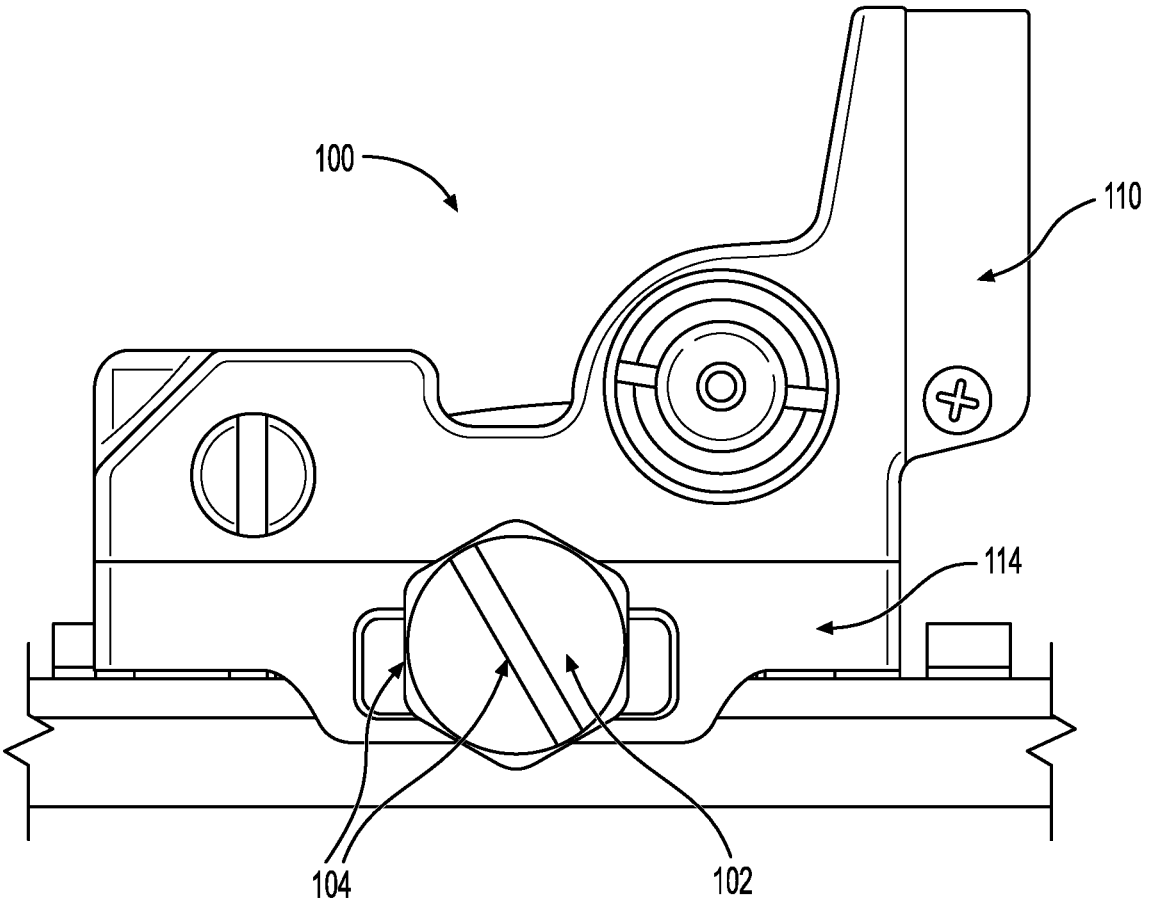
FIGS. 1A and 1B show front and side views of an accessory mounted on a rail.
Figure 1B:
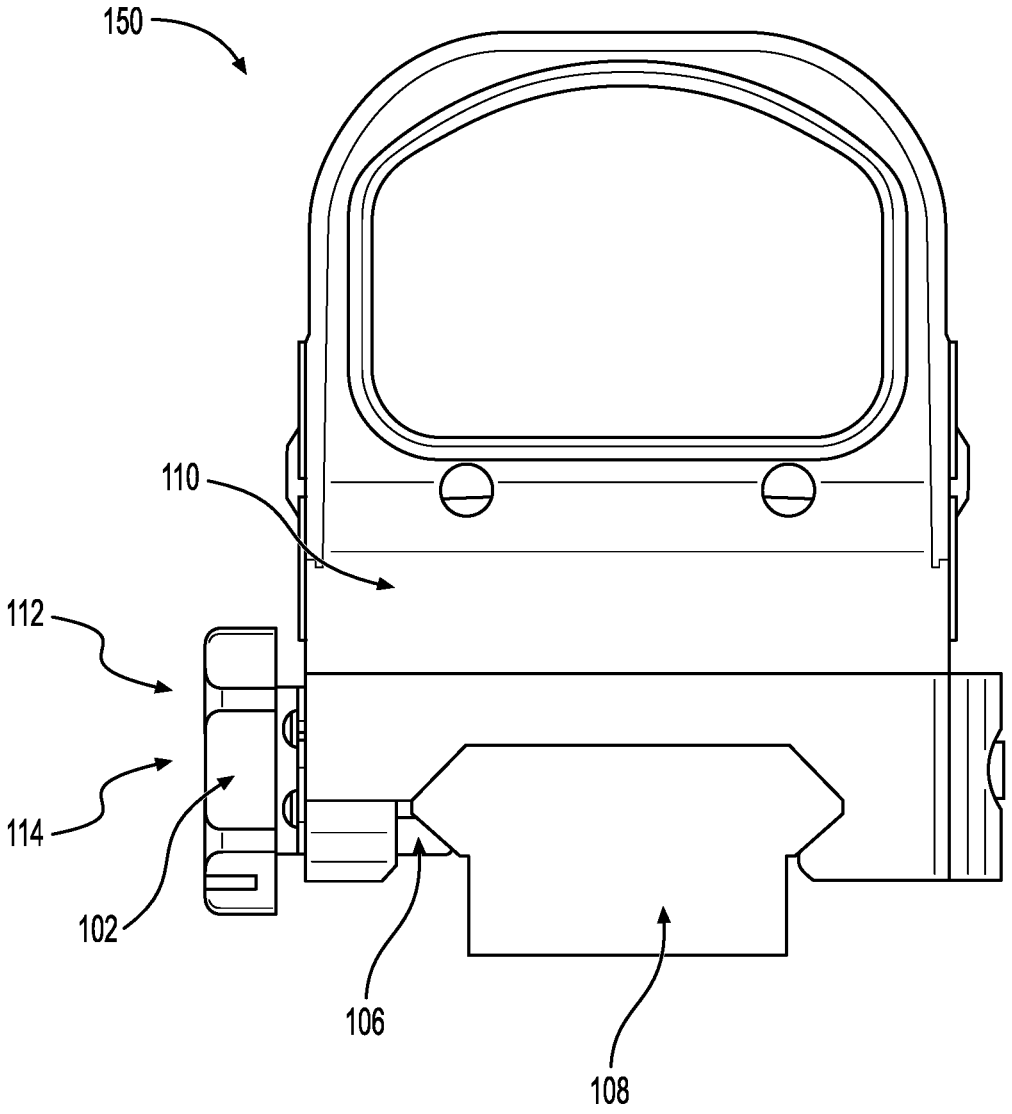

FIGS. 1A and 1B show a front view 100 and side view 150 of an accessory body 110 mounted on a rail 108 via a locking rail mount 114. In these exemplary views 100 and 150, the accessory includes an optical sight, but other types of accessories may be used. Locking rail mount 114 includes and/or connects with body 110, which is arranged to be mounted adjacent to mounting rail 108. The mounting rail 108 extends in a first direction and includes a plurality of ties such as ties 214 and 220 that extend at least partially across rail 108 in a second direction substantially perpendicular to the first direction. A clamp screw 102 extends through a channel 216 defined by body 110 and across mounting rail 108 in the second direction. In some implementations, clamp screw 102 causes minimum obscuration. Mounting rail 108 may include multiple channels such as channels 216 and 222 extending between ties of rail 108.

Clamp screw 102 and/or 224 may include screw head 112 having a first surface 218 facing away from mounting rail 108 and a second surface 210 facing toward mounting rail 108. The second surface 210 includes a plurality of locking elements 206, each having a surface relief geometry. Rail clamp 106 is arranged to engage with a first end of tie 214 of the plurality of ties 214 and 220 to hold body 110 adjacent to mounting rail 108 and disengage from the first end of the tie 214 and release body 110 from adjacent to mounting rail 108. Screw head 112 may include tool features 104 that enable operation of the screw 112 using a tool such as a screwdriver.

At least one compression spring 204 is positioned between body 110 and rail clamp 106. The at least one compression spring 204 applies a compression force that pushes a surface 212 and/or 414 of rail clamp 106 toward surface 210 of screw head 112. Surface 212 of rail clamp 106 may include a plurality of locking elements 208 complementarily arranged with respect to a plurality of locking elements 206 on surface 210 of screw head 112 that have a complimentary and/or opposing surface relief geometry to locking elements 208. Locking elements 206 may including male locking elements while locking elements 208 include female locking elements or vice versa. When clamp screw 102 is tightened, the plurality of locking elements 206 and plurality of locking elements 208 are aligned to lock rail clamp 106 and clamp screw 102 together to prevent unintended rotation of clamp screw 102.

The body 110 may be a portion of an accessory such as, without limitation, an optical sight, camera, phone, light, laser, audio sensor, audio emitter, or detachably connectable tool. The surface relief geometry of elements 206 and 208 may include a cam angle. Mounting rail 108 may be located on, without limitation, a firearm, helmet, pack, wearable item, or vehicle. At least one compression spring 204 may cause axial movement along clamp screw 102 as clamp screw 102 is rotated to either tighten or loosen rail clamp 106. Locking rail mount 114 may include at least one disc spring 276.

At least one compression spring 204 and at least one disc spring 276 may cause axial movement along clamp screw 102 as clamp screw 102 is rotated to either tighten or loosen rail clamp 106. The axial movement along clamp screw 102 as clamp screw 102 rotates may provide a positive tactile interface to a user. The positive tactile interface may reduce the likelihood of clamp screw 102 being over-tightened to a point of damaging the mechanics of locking rail mount 114. In some implementations, when clamp screw 102 is tightened to secure body 110 to rail 108, a rotation of clamp screw 102 with enough torque to overcome the increased compression spring pressure induced by the rail clamp's axial movement is required to loosen rail mounted body 110.

In some implementations, locking rail mount 114 is part of a rail mounting assembly where the rail mounting assembly includes a mounting interface arranged to connect an accessory to the rail mounting assembly while the rail mounting assembly uses locking rail mount 114 to connect to mounting rail 108. In one implementation, a firearm includes mounting rail 108 that is arranged to receive a rail mounting assembly having locking rail mount 114.

Figure 2A:
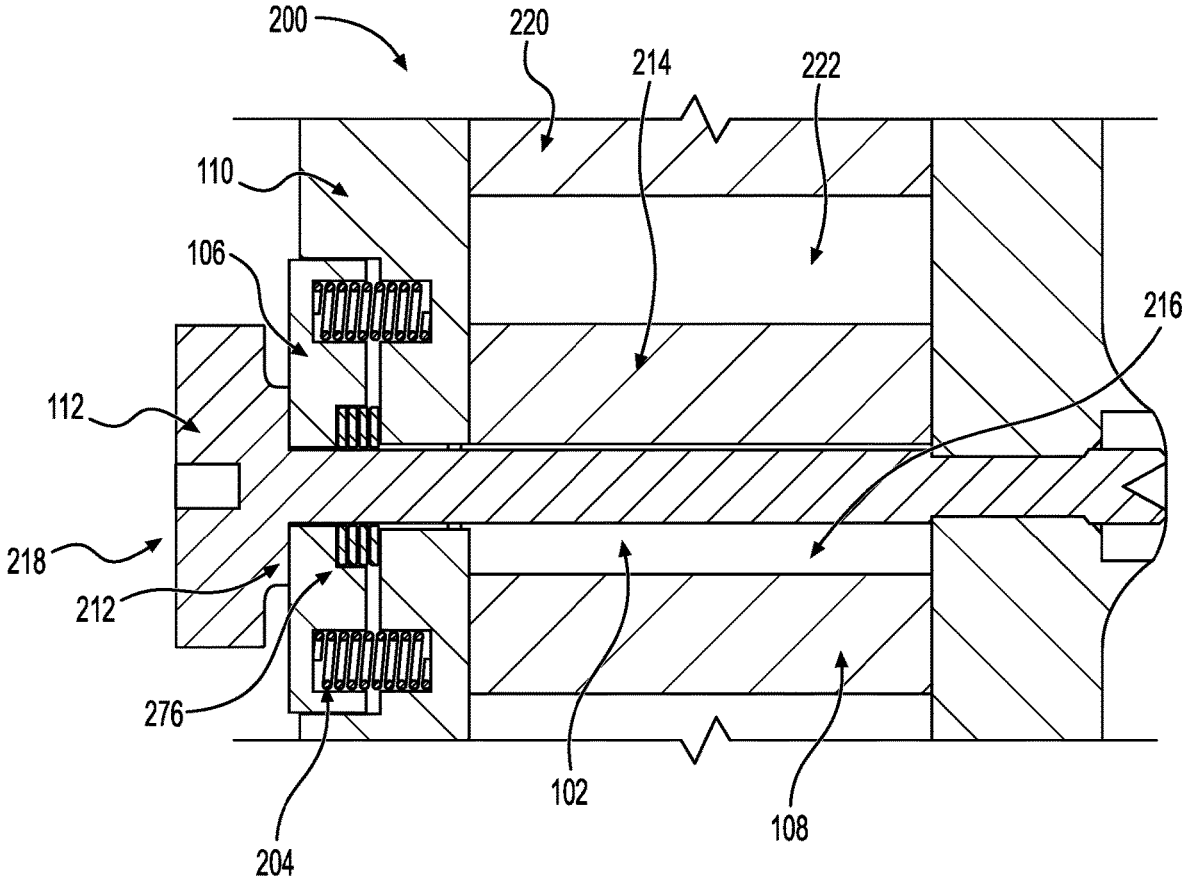
FIG. 2A shows a top-down cross-sectional view of a locking rail mount.

FIG. 2A shows a top-down cross-sectional view 200 of locking rail mount 114 of FIG. 1. FIG. 2A illustrates the position of various elements of rail mount 114 such as compression springs 204, disc springs 276, channels 216 and 222, ties 214 and 220, and outer surface 218 of screw head 112. One or more compression springs 204 may provide an extra stroke to push rail clamp 106 back away from the rail 108 for ease in mounting and removing body 110. Clamp screw 102 may also function as a crossbar in channel and/or slot 216 of rail 108.

Figure 2B:
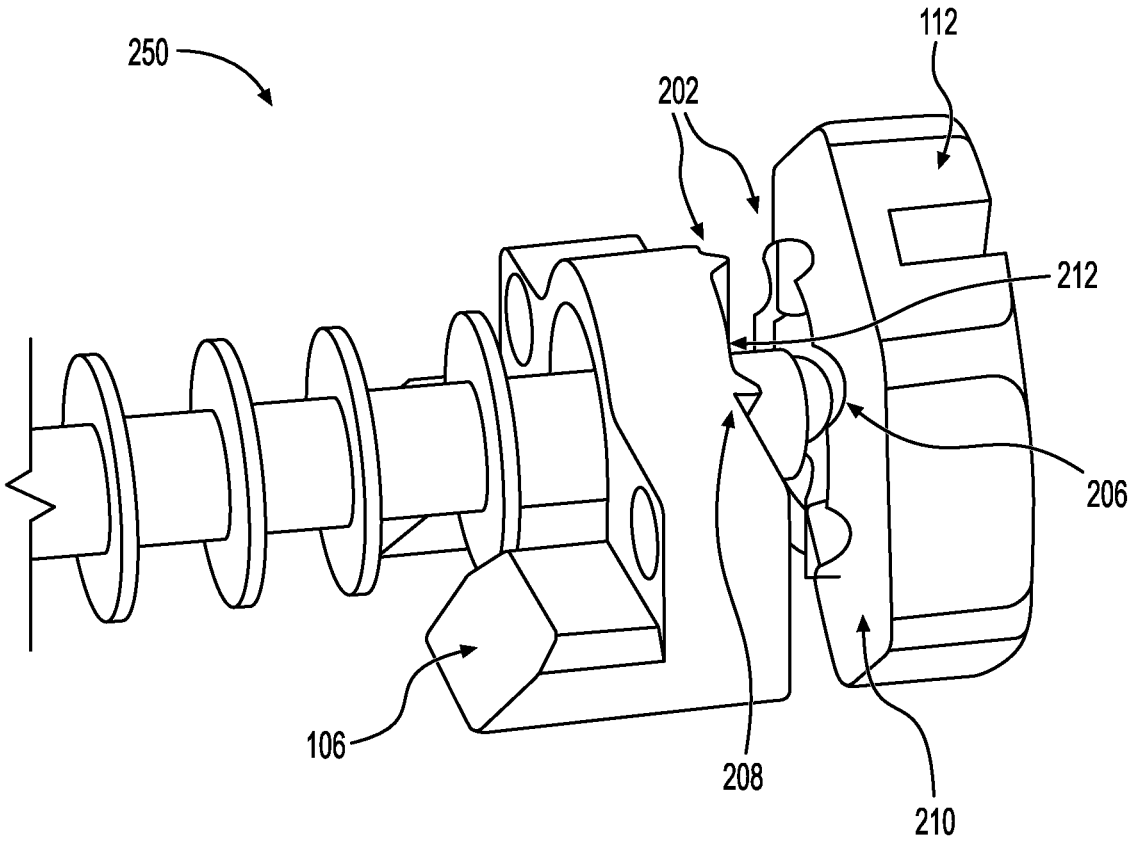
FIG. 2B shows perspective view of a screw head and rail clamp of FIG. 2A.

FIG. 2B shows perspective view 250 of screw head 112 and rail clamp 106 of FIG. 2A. FIG. 2B illustrates how locking features 202 such as locking elements 206 and 208 complimentarily oppose each other to enable locking of clamp screw 102.

Figure 2C:
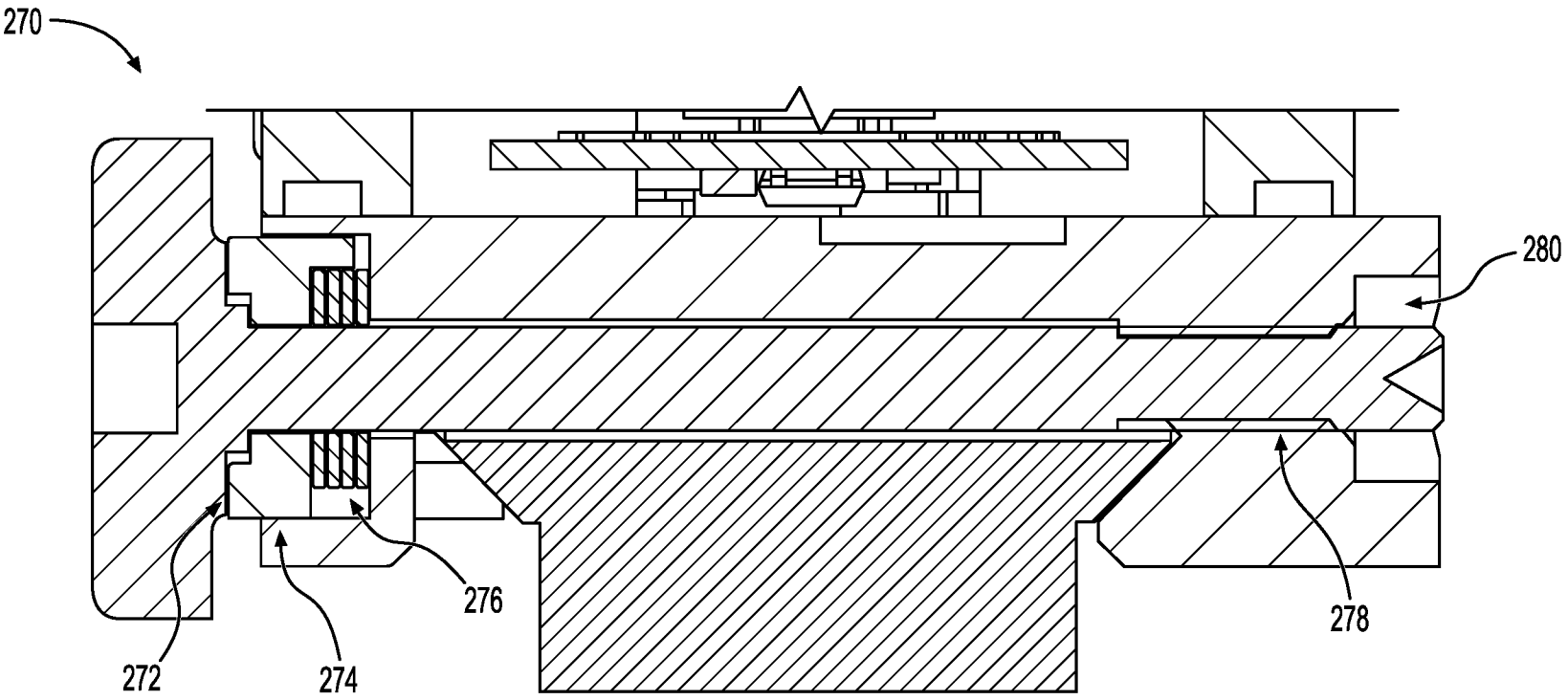
FIG. 2C shows a cross-sectional view of the locking rail mount of FIGS. 2A and 2B.

FIG. 2C shows a cross-sectional view 270 of locking rail mount 114 of FIGS. 1A, 1B, 2A and 2B. FIG. 2C illustrates male/female looking feature 272 shown in the "locked position" when locking elements 206 and 208 mate and/or are engaged with each other as clamp screw 102 is tightened. FIG. 2C shows heeled rail clamp 274 and/or 106 and a device base/clamp screw 102 threaded interface that enables clamp screw 102 to threadable engage with device body 110. Device body relief 280 may be configured to facilitate upsetting on end of clamp screw 102 to make it captive. Disc springs 276 may be stacked to provide a clamping force and required stroke.

Figure 3A:
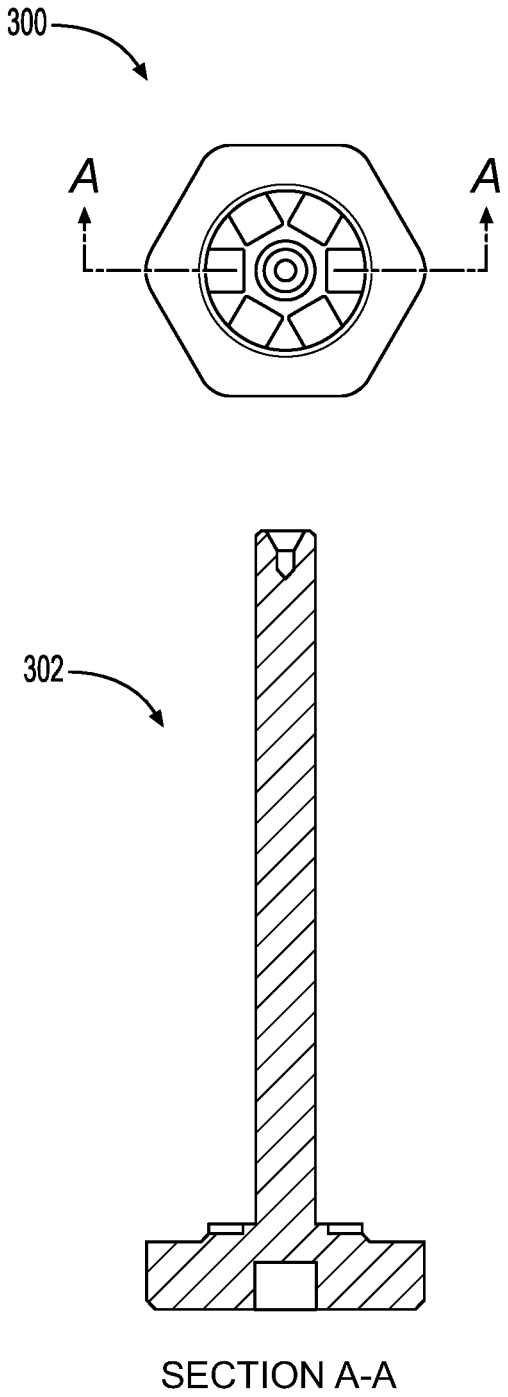
FIGS. 3A-3C show various views of the clamp screw and screw head of the locking rail mount of FIGS. 1A-2C.
Figure 3B:
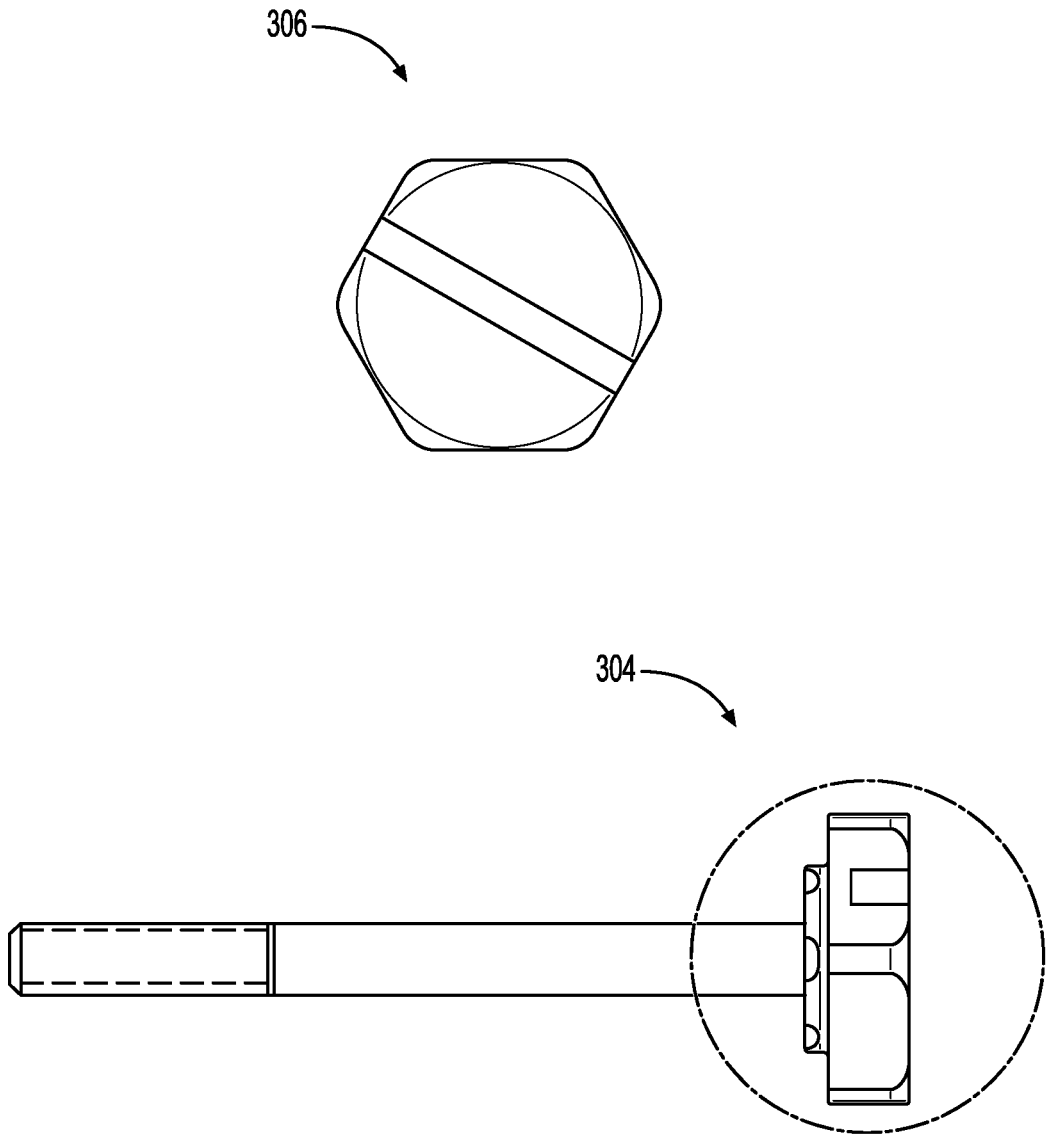
Figure 3C:
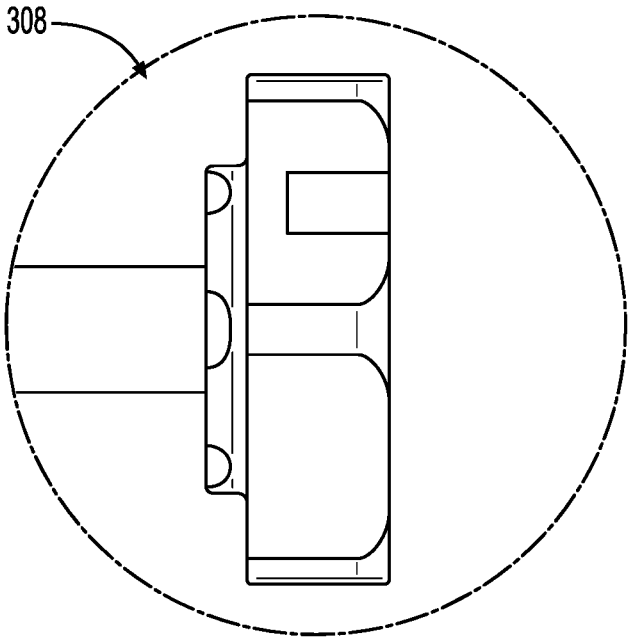
Figure 3C:
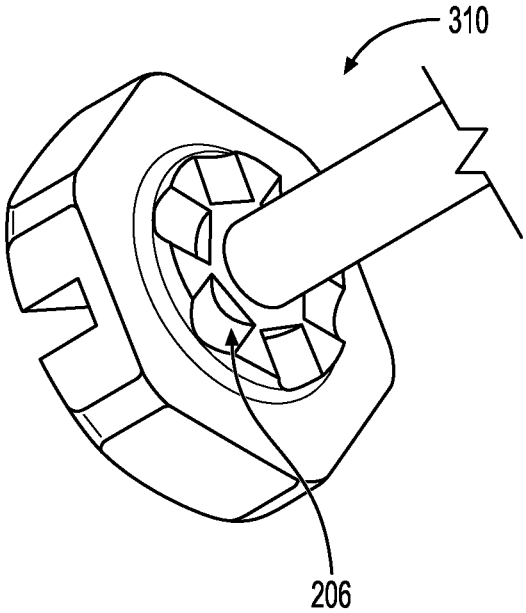

FIGS. 3A-3C show various views 300, 302, 304, 306, 308, and 310 of clamp screw 102 and screw head 112 of locking rail mount 114 of FIGS. 1A-2C. FIG. 3A shows a view 300 of surface 210 of screw head 112 and a corresponding cross-sectional view 302 of clamp screw 102. FIG. 3B shows a side view 304 of clamp screw 102 with a corresponding view of surface 218 of screw head 112. FIG. 3C shows a side view of screw head 112 and a corresponding perspective view of screw head 112 illustrating locking elements 206 on surface 210 of screw head 112.

Figure 4A:
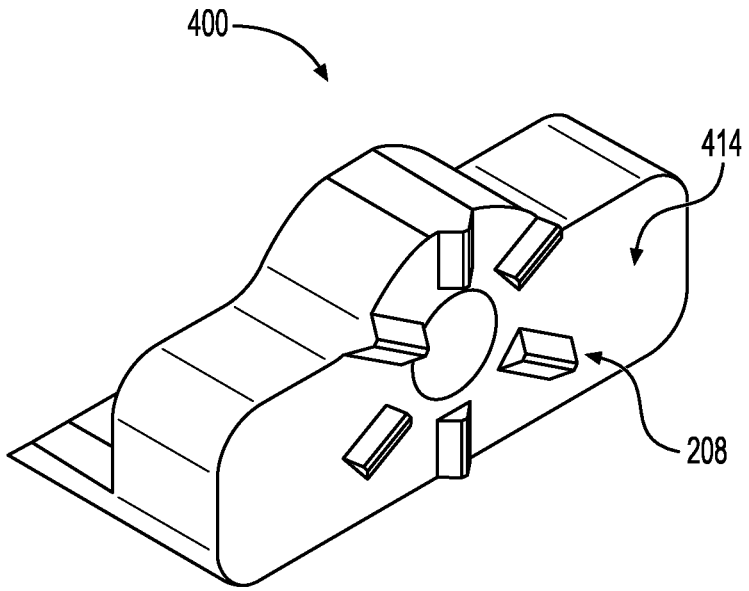
FIGS. 4A-4G show various views of the rail clamp of FIGS. 1A-2C.
Figure 4B:
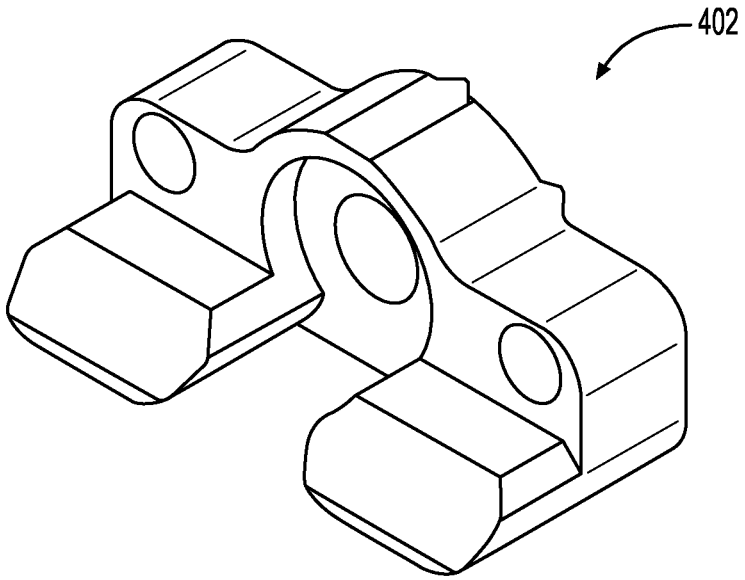
Figure 4C:
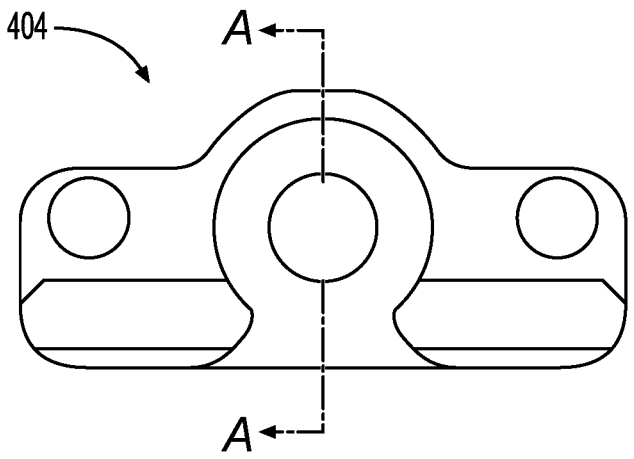
Figure 4D:
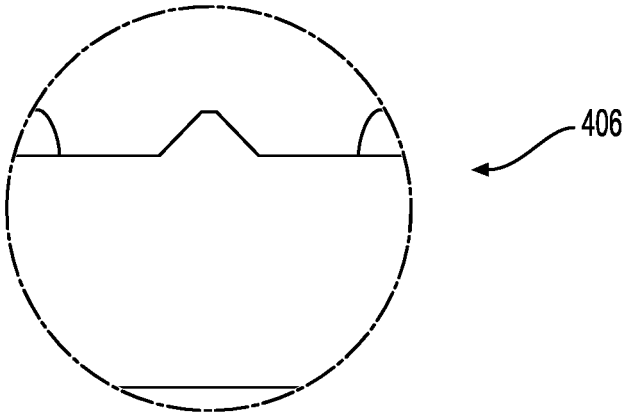
Figure 4E:
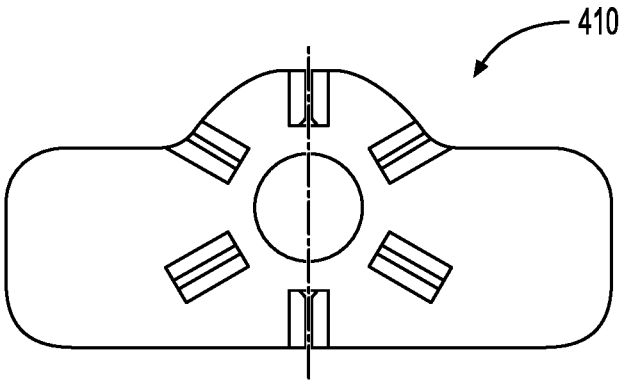
Figure 4F:
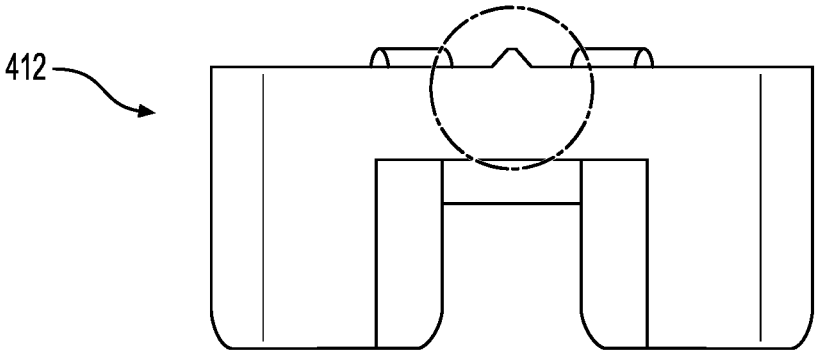
Figure 4G:
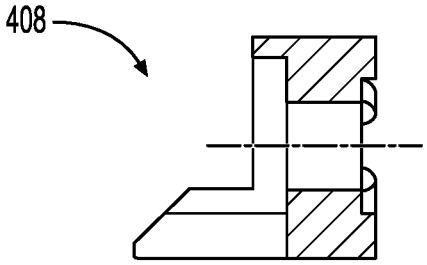

FIGS. 4A-4G show various views 400, 402, 404, 406, 408, 410, and 412 of rail clamp 106 of FIGS. 1A-2C. FIG. 4A shows a perspective view 400 surface 414 of rail clamp 106 including locking elements 208. FIG. 4B shows another perspective view 402 of rail clamp 106. FIG. 4C shows a back-facing view 404 of rail clamp 106, i.e. a view of the surface of rail clamp 106 facing toward mounting 108. FIG. 4D shows a zoomed-in view 406 of a locking element 208 on surface 414 of rail clamp 106. FIG. 4E shows front-facing view 410 of rail clamp 106 with surface 414 including locking elements 208. FIG. 4F shows top down view 412 of rail clamp 106. FIG. 4G shows a side view 408 of rail clamp 106.

Elements or steps of different implementations described may be combined to form other implementations not specifically set forth previously. Elements or steps may be left out of the systems or processes described previously without adversely affecting their operation or the operation of the system in general. Furthermore, various separate elements or steps may be combined into one or more individual elements or steps to perform the functions described in this specification.

Other implementations not specifically described in this specification are also within the scope of the following claims.

What is claimed is:

1. A locking rail mount comprising:

a body arranged to be mounted adjacent to a mounting rail, the mounting rail extending in a first direction and including a plurality of ties extending at least partially across the rail in a second direction substantially perpendicular to the first direction;

a clamp screw extending through a channel defined by the body and across the mounting rail in the second direction, the clamp screw including a screw head having a first surface facing away from the mounting rail and a second surface facing toward the mounting rail, the second surface including a first plurality of locking elements having a first surface relief geometry;

a rail clamp arranged to: i) engage with a first end of a first tie of the plurality of ties to hold the body adjacent to the mounting rail; and ii) disengage from the first end of the first tie of the plurality of ties and release the body from adjacent to the mounting rail; and at least one compression spring positioned between the body and the rail clamp, the at least one compression spring applying a compression force that pushes a first surface of the rail clamp toward the second surface of the screw head, the first surface of the rail clamp including a second plurality of locking elements complementarily arranged with respect to the first plurality of locking elements and having a second surface relief geometry complementary to the first surface relief geometry;

wherein, when the clamp screw is tightened, each of the first plurality of locking elements and each of the second plurality of locking elements are aligned to lock the rail clamp and clamp screw together to prevent unintended rotation of the clamp screw.

2. The locking rail mount of claim 1, wherein the body is a portion of an accessory.

3. The locking rail mount of claim 2, wherein the accessory includes one of an optical sight, camera, phone, light, laser, audio sensor, audio emitter, and detachably connectable tool.

4. The locking rail mount of claim 1, wherein the first surface relief geometry and the second surface relief geometry include a cam angle.

5. The locking rail mount of claim 1, wherein the mounting rail is located on one of a firearm, helmet, pack, wearable item, and vehicle.

6. The locking rail mount of claim 1, wherein the at least one compression spring causes axial movement along the clamp screw as the clamp screw is rotated to either tighten or loosen the rail clamp.

7. The locking rail mount of claim 6 comprising at least one disc spring, wherein the at least one compression spring and the at least one disc spring cause the axial movement along the clamp screw as the clamp screw is rotated to either tighten or loosen the rail clamp.

8. The locking rail mount of claim 7, wherein the axial movement along the clamp screw as the clamp screw rotates provides a positive tactile interface to a user.

9. The locking mil mount of claim 8, wherein the positive tactile interface reduces the likelihood of the clamp screw being over-tightened to a point of damaging the mechanics of the locking rail mount.

10. The locking rail mount of claim 1, wherein, when the clamp screw is tightened to secure the body to the rail, a rotation of the clamp screw with enough torque to overcome the increased compression spring pressure induced by the rail clamp's axial movement is required to loosen the rail mounted body.

11. A firearm accessory comprising:

a mounting interface arranged to connect the accessory to a rail mounting assembly; and the rail mounting assembly including:

a body arranged to be mounted adjacent to a mounting rail, the mounting rail extending in a first direction and including a plurality of ties extending at least partially across the rail in a second direction substantially perpendicular to the first direction;

a clamp screw extending through a channel defined by the body and across the mounting rail in the second direction, the clamp screw including a screw head having a first surface facing away from the mounting rail and a second surface facing toward the mounting rail, the second surface including a first plurality of locking elements having a first surface relief geometry;

a rail clamp arranged to: i) engage with a first end of a first tie of the plurality of ties to hold the body adjacent to the mounting rail; and ii) disengage from the first end of the first tie of the plurality of ties and release the body from adjacent to the mounting rail; and at least one compression spring positioned between the body and the rail clamp, the at least one compression spring applying a compression force that pushes a first surface of the rail clamp toward the second surface of the screw head, the first surface of the rail clamp including a second plurality of locking elements complementarily arranged with respect to the first plurality of locking elements and having a second surface relief geometry complementary to the first surface relief geometry;

wherein, when the clamp screw is tightened, each of the first plurality of locking elements and each of the second plurality of locking elements are aligned to lock the rail clamp and clamp screw together to prevent unintended rotation of the clamp screw.

12. The firearm accessory of claim 11, wherein the firearm accessory includes one of an optical sight, camera, light, laser, audio sensor, audio emitter, and detachably connectable tool.

13. The firearm accessory of claim 11, wherein the first surface relief geometry and the second surface relief geometry include a cam angle.

14. The firearm accessory of claim 11, wherein the mounting rail is located on a portion of the firearm.

15. The firearm accessory of claim 11, wherein the at least one compression spring causes axial movement along the clamp screw as the clamp screw is rotated to either tighten or loosen the rail clamp.

16. The firearm accessory of claim 15 comprising at least one disc spring, wherein the at least one compression spring and the at least one disc spring cause the axial movement along the clamp screw as the clamp screw is rotated to either tighten or loosen the rail clamp.

17. The firearm accessory of claim 16, wherein the axial movement along the clamp screw as the clamp screw rotates provides a positive tactile interface to a user.

18. The firearm accessory of claim 17, wherein the positive tactile interface reduces the likelihood of the clamp screw being over-tightened to a point of damaging the mechanics of the locking rail mount.

19. The firearm accessory of claim 11, wherein, when the clamp screw is tightened to secure the body to the rail, a rotation of the clamp screw with enough torque to overcome the increased compression spring pressure induced by the rail clamp's axial movement is required to loosen the rail mounted body.

20. A firearm comprising:

a mounting rail arranged to receive a rail mounting assembly; and the rail mounting assembly including:

a body arranged to be mounted adjacent to the mounting rail, the mounting rail extending in a first direction and including a plurality of ties extending, at least partially across the rail in a second direction substantially perpendicular to the first direction;

a clamp screw extending through a channel defined by the body and across the mounting rail in the second direction, the clamp screw including a screw head having a first surface facing away from the mounting rail and a second surface facing toward the mounting rail, the second surface including a first plurality of locking elements having a first surface relief geometry;

a rail clamp arranged to: i) engage with a first end of a first tie of the plurality of ties to hold the body adjacent to the mounting rail; and ii) disengage from the first end of the first tie of the plurality of ties and release the body from adjacent to the mounting rail; and at least one compression spring positioned between the body and the rail clamp, the at least one compression spring applying a compression force that pushes a first surface of the rail clamp toward the second surface of the screw head, the first surface of the rail clamp including a second plurality of locking elements complementarily arranged with respect to the first plurality of locking elements and having a second surface relief geometry complementary to the first surface relief geometry;

wherein, when the clamp screw is tightened, each of the first plurality of locking elements and the second plurality of locking elements are aligned to lock the rail clamp and clamp screw together to prevent unintended rotation of the clamp screw.

* * * * *